United States Patent [19]

Waldrum

[11] Patent Number: 4,760,963

[45] Date of Patent: Aug. 2, 1988

[54] GROUND SPRAY APPLICATOR

[76] Inventor: John E. Waldrum, 349 Fairview Ave., Ambler, Pa. 19002

[21] Appl. No.: 885,773

[22] Filed: Jul. 15, 1986

[51] Int. Cl.[4] ..... B05B 3/12

[52] U.S. Cl. ..... 239/245; 239/558

[58] Field of Search ..... 239/214, 214.15, 240, 239/239, 242, 245, 248, 243, 244, 263–263.3, 214.13, 556, 558, 554; 134/123

[56] References Cited

U.S. PATENT DOCUMENTS

| | | | |
|---|---|---|---|
| 910,400 | 1/1909 | Zischer | 239/244 X |
| 2,880,938 | 4/1959 | Stewart et al. | 239/245 |
| 2,970,771 | 2/1961 | Przystawik | 239/263.2 X |
| 3,261,369 | 7/1966 | Thiele | 134/123 |
| 3,379,379 | 4/1968 | Orem | 239/263.2 X |
| 3,391,701 | 7/1968 | Richardson et al. | 239/243 X |
| 3,642,206 | 2/1972 | Waldrum | 239/214 |

FOREIGN PATENT DOCUMENTS

| | | | |
|---|---|---|---|
| 476478 | 5/1929 | Fed. Rep. of Germany | 239/243 |

*Primary Examiner*—Andres Kashnikow
*Assistant Examiner*—Kevin Patrick Weldon
*Attorney, Agent, or Firm*—Steele, Gould & Fried

[57] ABSTRACT

An agricultural spray device comprising rotationally reciprocating spray heads moving in opposite directions relative to one another, provides for delivery of a liquid spray in a uniform pattern with little or no drift from the target zone. The spray heads which each carry one or more spray nozzles are set in rotationally reciprocating motion by eccentric drive connections from a common rotating drive. The spray nozzles are fed from a remote liquid supply tank through a liquid distribution system in which all joints between component parts are fixed relative to each other to eliminate the need for liquid seals between parts which move relative to one another.

12 Claims, 4 Drawing Sheets

GROUND SPRAY APPLICATOR

Figure 1:
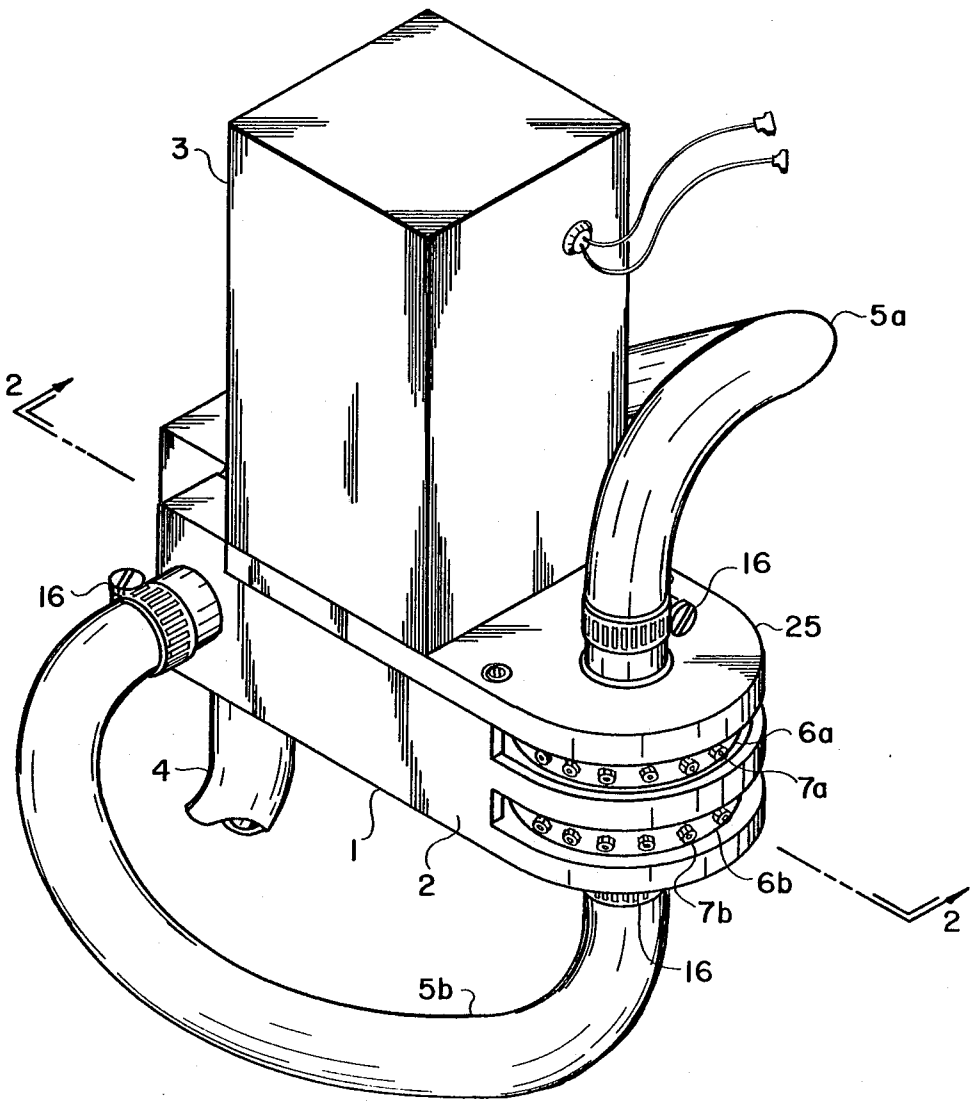

This invention relates to a spray device for applying liquids to ground or water surfaces from a vehicle or boat moving over the surface of the ground or water. More particularily the invention provides a novel spray device to be mounted on a carrier for applying low volumes of agricultural chemicals such as pesticides and plant growth regulators in uniform high density patterns without the formation of fines or mist and consequently little or no spray drift.

There are a number of known spray devices available for ground application (i.e., as compared to aerial spray devices) of liquids such as herbicides, insecticides, fungicides, plant growth regulators and other agricultural chemicals. Most often such applications are accomplished by the use of boom devices in which a series of nozzles are mounted laterally along a spray boom with each nozzle producing a fan or conical spray that generally travels only a short distance from the nozzle to the spray target area. Usually the distance is the height of the boom off the ground which may vary from a few inches to several feet. The uniformity of the spray pattern is determined by the spray pattern of the individual nozzles and their spacing to avoid gaps or overlap. The swath width is limited by the boom and the distance between spray nozzle and target is generally limited to a few feet without the risk of excessive drift resulting from the formation of too much mist and fines.

Another commonly used ground spray device is the fire nozzle also known as the "Mystery" nozzle. This type nozzle which is similar to the ordinary garden hose nozzle shoots liquid out to long distances but creates an extensive amount of fines and mist with considerable drift. Still other devices are known which utilize high pressure liquid spray through rotating or spinning spray heads that throw the liquid by centrifugal force through 360°. These devices similarily suffer from the production of excessive mist and fines. The spray area can be limited to less than 360° by the use of cut-off valves or similar mechanisms such as described in U.S. Pat. No. 3,642,206, but the problem of drift from the formation of mist and fines remains.

Attempts to eliminate drift have had only limited success in devices such as nozzles in which a high pressure liquid jet is directed into a baffled nozzle cavity to produce a swirling action before the spray liquid exits the nozzle thereby limiting the escape of small droplets or fines.

All of these prior art devices suffer in one way or another from limitations with respect to the spray distance, the spray volume per unit of surface areas, the swath width or the spray pattern uniformity and density that can be achieved without undue drift problems. These and other shortcomings of the prior art devices have been overcome by the spray device of this invention which will produce a dense uniform spray pattern with lower volumes, wider swath widths and longer spray distances with little or no drift.

Accordingly it is an object of the present invention to provide a ground spray device for low volume application of liquids in a dense uniform spray pattern without drift.

Another object of the invention is to provide a spray device that is especially well adapted for spraying liquid suspensions, dispersions, wettable powder solutions, emulsions and the like.

Still another object of the invention is to provide a rotationally driven spray device without any liquid seals between components moving relative to each other.

Yet another object of the invention is the provision of a liquid spray device that will operate to produce either a horizontal or a vertical spray swath.

And still another object of the invention is a spray device for uniform distribution over a wide swath at long distances from the spray nozzles.

And a particular object of the invention is to provide a spray device that can produce a wide spray swath where the use of boom mounted spray nozzles is impractical such as uneven terrain, roadsides with obstacles such as trees, poles, etc., and areas where a vertical swath is appropriate.

These and other objects of the invention are achieved by providing a radial spray device in which two or more spray heads each carrying one or more spray nozzles rotationally reciprocate around a common axis in opposite directions through less than 180° of arc. The spray device itself consists of at least two nozzle heads fixed to a common rotational axis and set into reciprocal motion by separate drive rods. Each drive rod is attached at one end to the respective spray head by a pivot pin and bearing located on each of the separate spray heads a distance away from the axis and in generally opposite directions from the axis. The other end of each of the respective drive rods is attached to a rotating cam shaft through a bearing to enable the rotational motion of the drive shaft to be converted to lateral motion of the drive rods. More than two spray heads with corresponding drive rods and cam shaft configurations can be provided in order to produce even more dense spray patterns through generally two spray heads are sufficient to carry sufficient nozzles to achieve the required spray density without having the spray head diameter too large.

In general the spray device of this invention comprises a set of two spray heads of generally cylindrical shape carrying multiple spray nozzles, preferably the same number in each spray head, evenly spaced along a segment of the outer radial wall of the spray heads. The spray is fed to the nozzles through individual channels in the spray head emanating radially from a hollow central cavity to each peripheral nozzle. Alternatively the spray head can be formed as a hollow cylinder though the channeling provides a more even continuous supply to each nozzle. The hollow central cavity of each spray head is connected to a liquid supply tube through a connecting nipple which is preferably made as an integral part of the spray head though it could be provided as a connector or adaptor fitted at one end to the spray head and at the other end to the supply tube. The supply tubes to the two spray heads are fed from a common supply source through a manifold contained within the spray device housing though any suitable means for dividing the liquid supply such as a simple T-joint could be utilized.

In a preferred embodiment the invention provides a device for imparting opposed rotationally reciprocating motion to a set of two spray heads each carrying an array of spray nozzles located along a section of the perimeter of each spray head. As the spray heads reciprocate, the spray nozzles move in an arcuate path to deliver a series of parallel liquid streams which break up into separate droplets that reach the ground in continuous parallel waves as the entire spray device is moved forward with the carrier vehicle. The opposed movement of the spray heads creates a criss-crossing pattern of spray droplets that provides a more uniform distribution then could be achieved with known devices.

This invention and its numerous advantageous features together with the improvement over known spray devices will be more fully appreciated by reference to the accompanying drawings and the detailed description of a preferred embodiment which follow. The invention is not limited by the embodiment shown but as will be readily appreciated is intended to include such equivalents as are readily apparent to these skilled in the art. The drawings include:

FIG. 1 which is an isometric of the assembled device.

Figure 2:
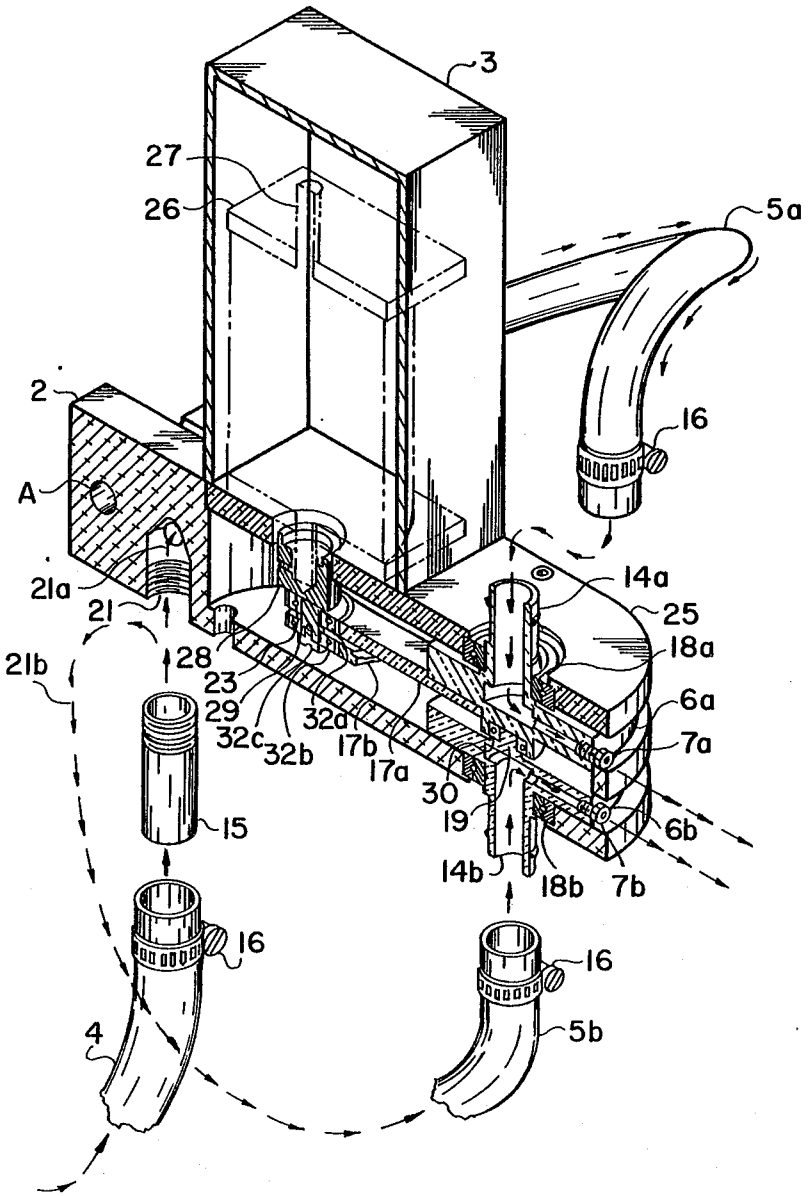

FIG. 2 which is an isometric cross section taken along lines 2—2 of FIG. 1.

Figure 3:
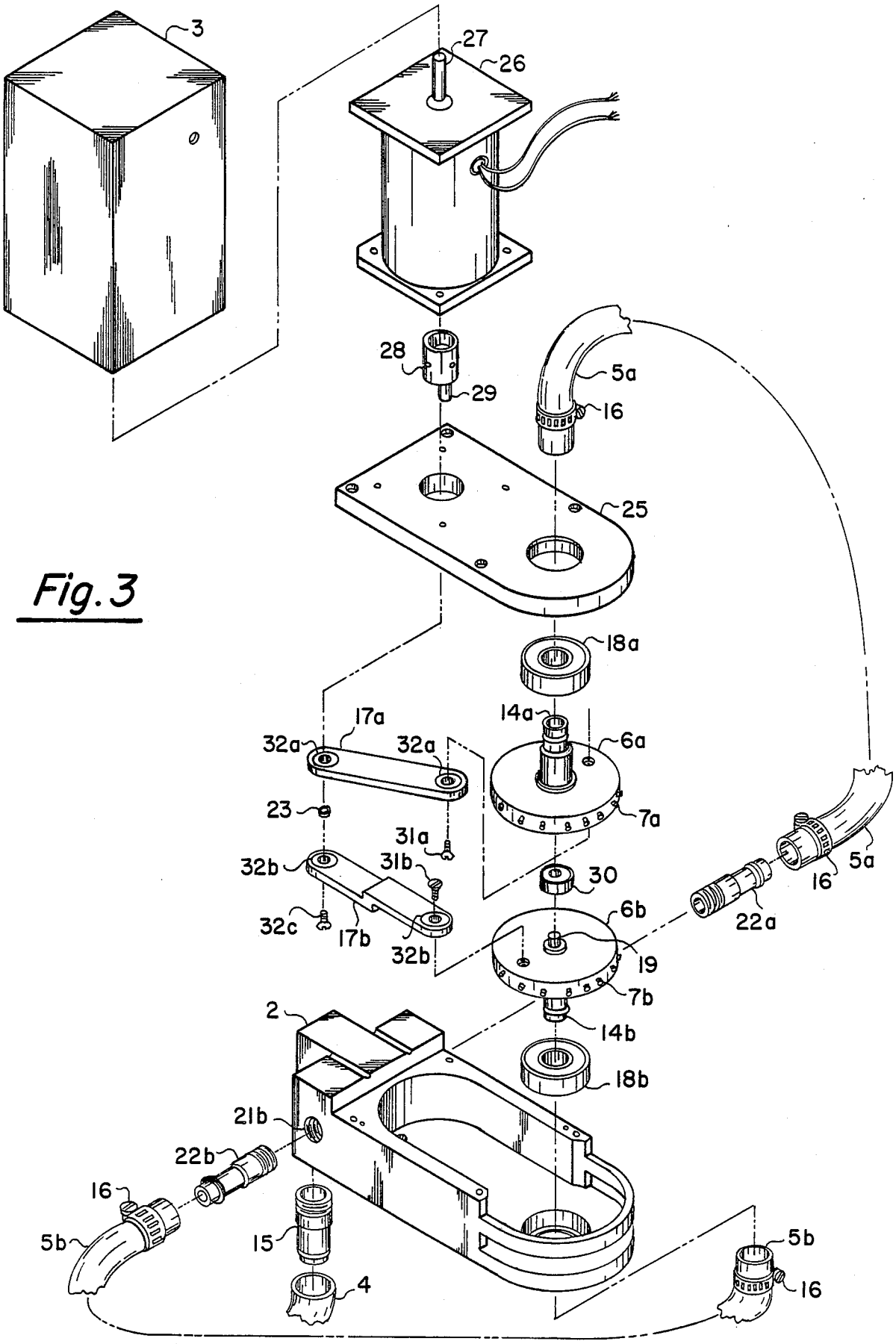

FIG. 3 which is an exploded isometric of the separate components that make up the device.

Figure 4:
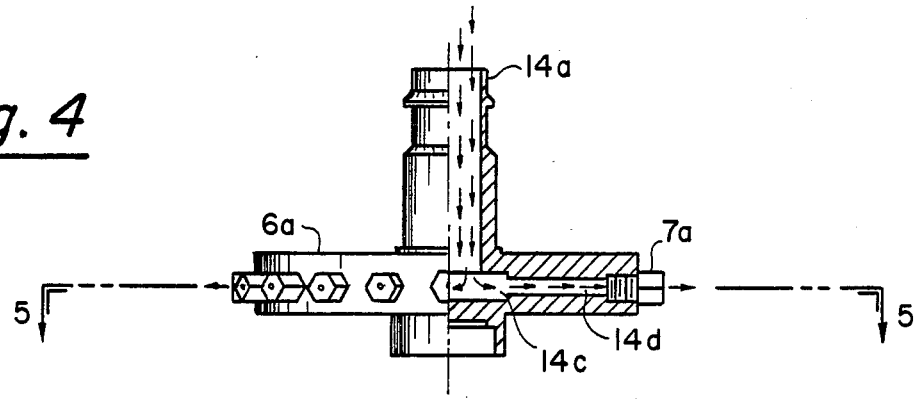

FIG. 4 which is a partial cross section of a spray head shown in top view.

Figure 5:
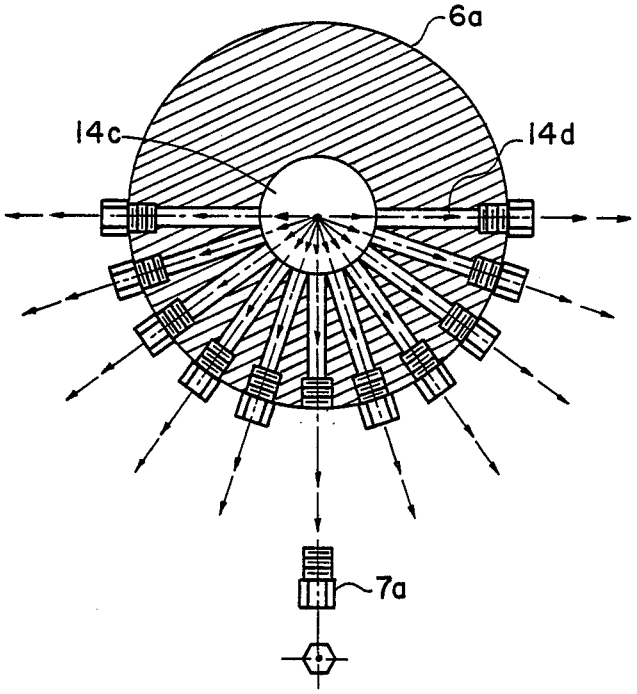

FIG. 5 which is a cross section taken along lines 5—5 of FIG. 4.

Referring now in greater detail to the various figures of the drawings wherein like reference characters refer to like parts there is shown at 1 in FIG. 1 a rotationally reciprocating spray device embodying the present invention. As further illustrated by FIGS. 1, 2 and 3 the spray device comprises a spray head block 2 having a liquid manifold in one end comprising bottom inlet 21 which divides into outlets 21*a* and 21*b* in fluid communication with inlet 21 and opening on either side of block 2. The main body of block 2 is generally hollow and open to the end opposite the manifold end in two parallel arcuate openings. To the top of block 2 is affixed a motor housing 3. The front top portion of block 2 is cut away as shown, this permits ease in machining the block. The cut away top is replaced by top plate 25 though the entire block 2 could be made as an integral unit by casting, molding or the like. The motor housing 3 will accommodate any convenient rotary motor, such as electric motor 26 having a drive shaft 27 and drive coupling 28 attached at one end to drive shaft 27 along a common axis and at the other end to drive coupling shaft 29 which has its axis attached off center with respect to the axis of coupling 28 and drive shaft 27 so that 28 and 29 together form a cam shaft. Alternatively shafts 27, and 29 and coupling 28 could be provided as an integral cam shaft.

Located inside the hollow chamber of block 2 in the forward end is the spray head assembly comprising spray heads 6-*a* and 6-*b* carrying nozzles shown as 7-*a* and 7-*b*. The spray heads are parallel to the bottom of block 2 so that a central hollow pivotal axis 14-*b* attached to the bottom face of spray head 6-*b* is rotatably mounted in a sealed ball-bearing ring 18-*b* which is in turn seated in an opening provided therefor in the bottom of block 2. Attached to the top of spray head 6-*b* and in axial alignment with hollow pivotal axis 14-*b* is a solid pivot axis 19 carrying sealed ball bearing ring 30 mounted between spray heads 6-*a* and 6-*b* to provide an intermediate bearing surface for rotational movement of both spray heads in opposite directions. Spray head 6-*a* has on its bottom a centrally located recess to receive pivot head of spray head 6-*b* and thereby maintaining axial alignment between spray head 6-*a* and 6-*b*. Spray 6-*a* mirroring spray head 6-*b* also has attached to its upper side a hollow central pivotal axis 14-*a* rotationally mounted in a sealed ball bearing ring 18-*a* mounted in top plate 25 in an opening provided for it. Attached to spray heads 6-*a* and 6-*b* by means of rod pivot screws 31-*a* and 31-*b* are drive rods 17-*a* and 17-*b* respectively. These drive rods are secured to the spray heads at points displaced from the axis so as to provide eccentric points which enable the lateral motion of the drive rods to be translated into reciprocal partial rotary motion at the spray nozzles by reciprocally rotating each spray head about its axis through an arc of less then 180° and preferably less than 15°, more specifically about 2° to about 6° only and generally about 4° to 5°. To minimize friction the drive rods are secured to the respective spray heads by means of sealed ball bearings. The other ends of the drive rods 17-*a* and 17-*b* are mounted on drive coupling shaft 29 by means of sealed ball bearings 32-*a* and 32-*b* mounted in the ends of the drive rods. These are secured to the drive coupling shaft 29 by pivot screw 32-*c*. In order to minimize the space between the two drive rods, one of them, here shown as 17-*b* is provided with an offset so that at the spray head end both rods are in the same horizontal plane whereas at the drive shaft end they are mounted one above the other on to the drive shaft with a small spacer 23 to permit easy motion.

In use, spray liquid is fed into the manifold through supply tube 4 secured to adapter 15 by means of a ring clamp 16. The fluid enters the manifold in block 2 through adapter 15 into chamber or bottom inlet 21 and is then distributed through chambers or outlets 21-*a* and 21-*b* into flexible feed tubes 5-*a* and 5-*b* respectively by passing through hollow adapters 22-*a* and 22-*b* attached at one end to the chambers 21-*a* and 21-*b* and secured at the other by means of ring clamps 16 to the flexible feed tubes 5-*a* and 5-*b*. From the feed tubes spray liquid is fed into the hollow central chambers of spray heads 6-*a* and 6-*b* respectively through hollow nipples 14-*a* and 14-*b*, which also provide the pivotal axis for the rotational reciprocating spray heads. The flexible tubes are secured to the nipples by ring clamps. The construction of spray heads 6-*a* and 6-*b* can be more fully understood by reference to FIGS. 4 and 5. As seen in FIGS. 4 and 5, the fluid enters the central hollow core of the spray head through the nipple 14-*a* which is here shown as an integral part though it could as easily be made as a separate adaptor attached to the spray head by any suitable means. From nipple 14-*a* the fluid enters the central cup shaped core 14-*c* which is generally of wider diameter than the internal diameter of the hollow nipple. The fluid is distributed into a series of spray head channels 14-*d* and exits through the nozzles 7-*a* attached to the exit end of each spray head channel. The hollow central core can be of any suitable diameter but generally it is preferred to have diameter, depending on the number of spray head channels, sufficient to just keep the channels from overlapping at their inner end. This provides for maximum efficiency in distributing the liquid into the series of spray head channels.

In operation, the spray device can be mounted at any convenient location using mounting hole "A" (FIG. 2) on a suitable vehicle such as a truck for ground use or a boat for waterways. A short arm or a swivel mount can be used to adjust the mounting angle in relation to the vehicle and to allow the device to be rotated 90° to provide either a horizontal or a vertical swath. Normally the device is mounted as close to the ground as practicable to reduce wind effects but higher mounting permits greater swath widths. The spray device can be supplied from any convenient source such as a bulk tank or drum using a pump to deliver an adequate volume. A preferred pump is a centrifugal pump which will deliver about 90 gal./min. at 60 to 70 psi though others such as piston pumps may also be used so long as the pump supplies a steady, non-pulsating stream to the spray head.

Vehicle speeds of about 1 to 20 mmph, (preferably 5 to 15 mph) can be uesd with spray volume decreasing as forward speed increases. Higher speeds can be used with less drift control. The preferred operating pressure is from about 20 to 30 psi though higher or lower pressures can be used. Swath width increases as pressures increase and above about 30 psi drift control additives should be used to prevent drift from increased production of fines at such higher pressures.

The spray sector can be varied from about 5° to about 180° depending upon the number and spacing of nozzles in the spray heads. Similarily the spray pattern can be altered by number and placement of nozzles. As a rule, larger nozzles with larger orifices provide larger droplets. Generally the orifice sizes can vary between about 0.03 inch to about 0.1 inch though larger and smaller sizes may also be used. Suitable nozzles are those having orifice sizes of 0.030, 0.045, 0.070, 0.085 and 0.101 inch internal diameters. In use the spray device can be calibrated for volume per square unit of surface sprayed in accordance with known techniques by selecting orifice size, number of nozzles and setting the swath width by adjusting the pressure and then determining the volume per acre based on vehicle speed. Known devices can be added to maintain a constant volume with changing vehicle speed such as injection system or computer controls.

The reciprocating drive means is normally operated to produce about 100 to about 1000 ocillations per minute which is equivalent to the rpm of the rotary drive means. The preferred rate of ocillation is related to the nozzle size with the larger nozzle sizes 0.08 to 0.10 operating at about 300 to 500 rpm and the smaller nozzle sizes 0.045 to 0.070 at about 600 to 800 rpm.

While the device can be utilized to spray any liquid it is preferably used for agricultural chemicals for brush control along road sides, railroad tracks and right-of-way or for agronomic and forestry uses. In general it can be used for broad leaf weed control along highways for agronomic field crops, in orchards, for reforestation or control of weed in ditch banks, pastures and rangeland. Among the products that can be conveniently sprayed are, for example, the phenoxy weed and brush killers, pichloram, trichlopyr, dicamba, imazapyr, hexazinone, simazine, atrazine, fosamine and others. The device can be used for any pesticides including pre- and post-emergent herbicides or herbicides to be incorporated in tilled soil.

The spray device of this invention is especially well suited for low concentration, low volume application of herbicides or other agricultural chemicals such as plant growth regulators and the like. The device can easily apply between about 5 and about 100 gal./acre with excellent drift control and preferably it will be used to apply between about 10 and 30 gal./acre.

Without further elaboration, the above description illustrates the invention so that those skilled in the art applying present and future knowledge can readily adapt the invention to use under a variety of service conditions.

What is claimed as the invention is:

1. A ground spray applicator comprising a generally hollow spray head block having at least two liquid inlets;

a pair of generally circular first and second spray heads mounted for reciprocating arcuate movement within the block, each spray head comprising a central core, a plurality of peripherally positioned, arcuately spaced spray nozzles, a plurality of radially oriented spray channels extending from the central core to the periphery of the spray heads, the spray nozzles of the first spray head being in fluid communication via the respective central core and spray channels with one of the liquid inlets and the spray nozzles of the second spray head being in fluid communication via the respective central core and spray channels with the other liquid inlet and said spray nozzles directing the liquid spray pattern outwardly of the spray head block, the spray heads being coaxially positioned and being rotational about a common axis;

a motor secured to the spray head block, the motor having an output drive shaft, the drive shaft being rotational relative to the spray head block; and first and second eccentric drive means intermediate the motor drive shaft and the respective spray heads, to arcuately reciprocate the spray heads upon motor operation;

whereby a precisely controlled spray pattern from the spray nozzles can be produced.

2. The ground spray applicator of claim 1 wherein the spray channels are equally radially spaced about the spray head.

3. The ground spray applicator of claim 2 wherein the spray channels are equally spaced through an arc of one hundred and eighty degrees about the spray head.

4. The ground spray applicator of claim 1 wherein the first and second eccentric drive means comprise a first drive rod eccentrically connected to the output drive shaft and eccentrically connected to the first spray head.

5. The ground spray applicator of claim 4 wherein the first and second eccentric drive means further comprise a second drive rod eccentrically connected to the output drive shaft and eccentrically connected to the second spray head.

6. The ground spray applicator of claim 5 wherein the first and second drive rods are positioned in crossed relation to one another.

7. The ground spray applicator of claim 6 wherein one of the drive rods is provided with an offset.

8. The ground spray applicator of claim 7 wherein portions of the first and second drive rods lie in the same plane at their spray head connected ends.

9. The ground spray applicator of claim 8 wherein portions of the first and second drive rods are mounted one above the other at their drive shaft connected ends.

10. The ground spray applicator of claim 1 wherein the first and second drive means comprise crossed first and second drive rods, the first and second drive rods being interconnected between the drive shaft and the respective first and second spray heads to arcuately reciprocate the spray heads in opposite directions.

11. The ground spray applicator of claim 10 wherein the first and second drive rods are respectively secured to a spray head at a point displaced from the spray head axis so as to provide eccentric points which enable the motion of the drive rods to be translated into reciprocal partial rotary motion at the spray nozzles by reciprocally rotating each spray head about its axis through an arc of less than one hundred and eighty degrees and more than two degrees.

12. A ground spray applicator comprising a generally hollow spray head block having at least two liquid inlets;

a pair of generally circular first and second spray heads mounted for reciprocating arcuate movement within the block, each spray head comprising a plurality of peripherally positioned, arcuately spaced spray nozzles, the spray nozzles of the first spray head being in fluid communication with one of the liquid inlets and the spray nozzles of the second spray head being in fluid communication with the other liquid inlet, the spray heads being coaxially positioned and rotational about a common axis;

a motor secured to the spray head block, the motor having an output drive shaft, the drive shaft being rotational relative to the spray head block; and first and second eccentric drive means intermediate the motor drive shaft and the respective spray heads, to arcuately reciprocate the spray heads upon motor operation;

whereby a precisely controlled spray pattern from the spray nozzles can be produced;

wherein the first and second eccentric drive means comprise a first drive rod eccentrically connected to the output drive shaft and eccentrically connected to the first spray head, and further comprise a second drive rod eccentrically connected to the output drive shaft and eccentrically connected to the second spray head.

* * * * *